US007802534B2

(12) United States Patent
Chen

(10) Patent No.: US 7,802,534 B2
(45) Date of Patent: Sep. 28, 2010

(54) SELF PROPELLED HYDROFOIL DEVICE WITH LEVERAGE-BASED CONTROL OF DRIVE FOIL

(76) Inventor: Shane Chen, 1821 NW. Eight Ave., Camas, WA (US) 98607

( * ) Notice: Subject to any disclaimer, the term of this patent is extended or adjusted under 35 U.S.C. 154(b) by 0 days.

(21) Appl. No.: 11/593,141

(22) Filed: Nov. 3, 2006

(65) Prior Publication Data

US 2007/0125288 A1 Jun. 7, 2007

Related U.S. Application Data

(63) Continuation-in-part of application No. 11/375,538, filed on Mar. 13, 2006, now Pat. No. 7,434,530, which is a continuation-in-part of application No. 10/657,664, filed on Sep. 7, 2003, now Pat. No. 7,021,232.

(51) Int. Cl.
*B63B 1/24* (2006.01)

(52) U.S. Cl. ..... 114/274; 440/21

(58) Field of Classification Search ..... 114/274–282; 440/21–31

See application file for complete search history.

(56) References Cited

U.S. PATENT DOCUMENTS

| | | | | | |
|---|---|---|---|---|---|
| 2,955,559 | A * | 10/1960 | Palmer et al. | ..... | 114/281 |
| 4,077,351 | A * | 3/1978 | Girona | ..... | 440/30 |
| 4,349,340 | A * | 9/1982 | Hoffmann | ..... | 440/30 |
| 5,042,412 | A * | 8/1991 | Fouch | ..... | 114/39.17 |
| 6,178,905 | B1 * | 1/2001 | Dynes et al. | ..... | 114/55.54 |
| 7,144,285 | B1 * | 12/2006 | Hendricks | ..... | 441/74 |
| 2004/0139905 | A1 * | 7/2004 | Chen | ..... | 114/274 |
| 2005/0051074 | A1 * | 3/2005 | Chen | ..... | 114/274 |

* cited by examiner

*Primary Examiner*—Edwin Swinehart
(74) *Attorney, Agent, or Firm*—Steven J. Adamson

(57) ABSTRACT

A self-propelled hydrofoil device having front and rear foils, a support structure and a steering mechanism. The hydrofoil device is preferably configured such that a user can change the angle of attack of the drive foil and/or the height of the hydrofoil device in the water by placing the handle bar to a corresponding position. The steering mechanism is movably coupled to the user platform in a manner that provides a user with sufficient leverage to move the handle bar. A flexible steering-shaft joining member and dihedral foil configurations, among other features, are disclosed.

25 Claims, 5 Drawing Sheets

SELF PROPELLED HYDROFOIL DEVICE WITH LEVERAGE-BASED CONTROL OF DRIVE FOIL

CROSS REFERENCE TO RELATED APPLICATIONS

This application is a continuation-in-part of U.S. patent application Ser. No. 11/375,538, filed Mar. 13, 2006 now U.S. Pat. No. 7,434,530, and entitled "Collapsible Self Propelled Hydrofoil Device" by the same inventor as above. Patent application Ser. No. 11/375,538 is a continuation-in-part of U.S. patent application Ser. No. 10/657,664, filed Sep. 7, 2003, and entitled "Self Propelled Hydrofoil Device" by the same inventor as above, now issued as U.S. Pat. No. 7,021,232. These two documents are hereby incorporated by reference.

FIELD OF THE INVENTION

The present invention relates to hydrofoil devices and, more specifically, to hydrofoil devices that may be configured for self propelled operation, provide greater user control of drive foil operation and/or are efficient in design.

BACKGROUND OF THE INVENTION

Relevant prior art hydrofoil devices include the "Trampofoil" device disclosed in Swedish Design Patent no. 98-0088 and a Water Vehicle disclosed in U.S. Pat. No. 6,099,369 issued to Puzey.

The Trampofoil discloses a basic self-propelled hydrofoil device having a main foil in the rear and a steerable foil in the front. The '369 patent issued to Puzey discloses a related device that has a biased pivot point located substantially above the rear foil, i.e., under the area at which a user stands when in use (FIG. 9, item 82, or FIG. 10, item 72).

Disadvantageous aspects of the Trampofoil device and the '369 patent include that they are inefficient in their transfer of the user generated driving force to drive the foil. This inefficiency in turn renders them relatively exhausting to use and the experience short lived. The Trampofoil and '369 device have a drive foil that is biased into the "coast" position. To move it into a drive position, a user must jump onto the user platform and thrust downward. A large portion of this thrust does not go to driving the foil but rather to reorienting the foil from the coast to the drive position. Once reoriented, the remaining thrust force may go to driving the foil.

A need thus exists for a self-propelled hydrofoil device in which the drive foil may be placed in the appropriate drive position prior to a user thrust so that the energy of the user thrust is more efficiently used for driving the hydrofoil device forward. A need also exists for a hydrofoil device that affords a user greater control over foil position, leverage to assert that control and a simplicity of design that decreases costs while not impacting (and potentially improving) performance.

SUMMARY OF THE INVENTION

Accordingly, the present invention is directed towards a hydrofoil device that is more efficient to operate.

The present invention is also directed towards a hydrofoil device that affords a user greater control over the angle of attack of the drive foil.

The present invention is further directed towards a hydrofoil device that provides a simpler design.

These and related objects of the present invention are achieved by use of a self-propelled hydrofoil device with leverage based control of the drive foil as described herein.

In one embodiment, the present invention may include a front foil; a steering structure including a steering shaft and a handle bar coupled to the front foil; second foil; a user platform provided above the second foil; and a support frame that movably couples the steering structure to the user platform; wherein the device is configured such that the handle bar can be placed up or down by a user and through this up or down placement of the handle a user can change the angle of attack of the second foil.

In another embodiment, the present invention may include a related structure yet wherein the device is configured to operate in a coast position and a drive position and the handle bar can be placed up or down by a user, placement of the handle bar up or down in the coast position while in use serving to alter the height of the device in the water.

In yet other embodiment, the present invention may include a related structure yet wherein the steering shaft is pivotally coupled to the support frame at a main frame pivot and configured with the support frame to permit a user to alter the angle of attack of the second foil by exerting an upward or downward force on the handle bar of 25% or less of the weight of the user.

In other embodiments, the present invention may include a self-propelled hydrofoil device with a flexible joining member through which the steering shaft is movable coupled, a steering shaft that extends 30% or more above its point of attachment to the support frame or a dihedral foil.

The attainment of the foregoing and related advantages and features of the invention should be more readily apparent to those skilled in the art, after review of the following more detailed description of the invention taken together with the drawings.

BRIEF DESCRIPTION OF THE DRAWINGS

FIGS. 1-3 illustrate an embodiment of a self-propelled hydrofoil device configured to increase user leverage and control in accordance with the present invention.

DETAILED DESCRIPTION

Figure 1:
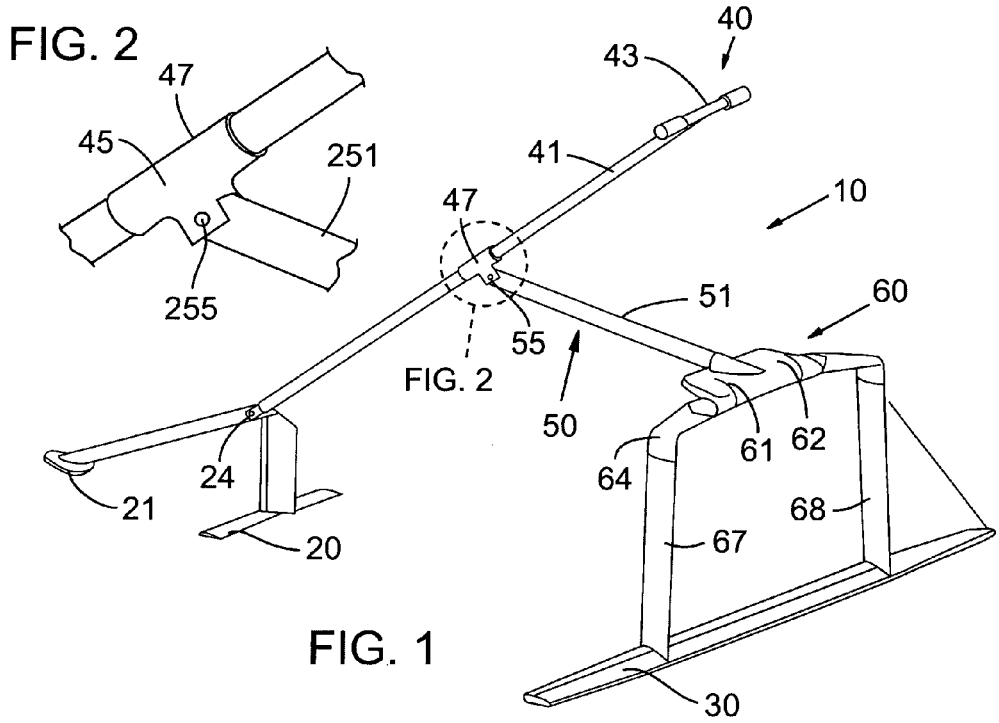
Figure 3:
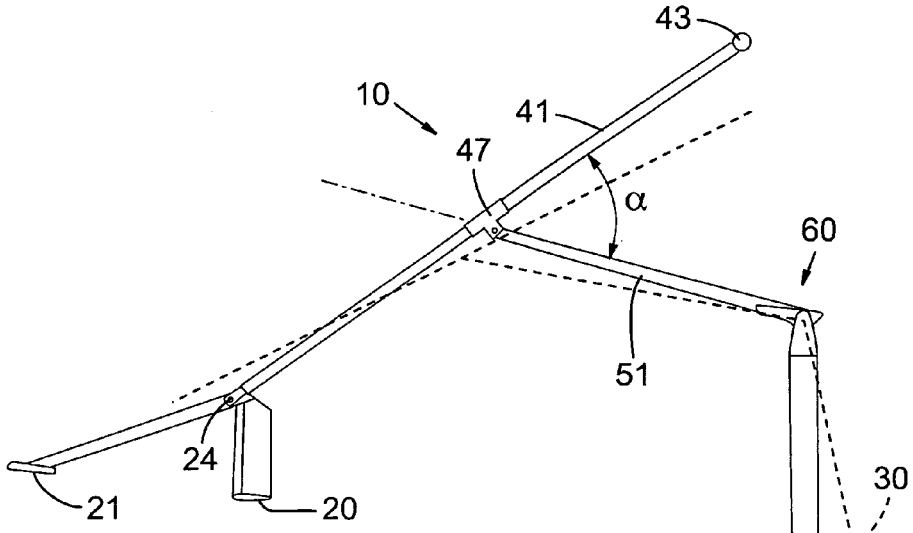

Referring to FIGS. 1-3, an embodiment of a self-propelled hydrofoil device 10 configured to increase user leverage and control in accordance with the present invention is shown. FIG. 1 illustrates a perspective view from the side-rear, FIG. 2 illustrates a sectional view of the main frame pivot and FIG. 3 is a side elevation view that includes a phantom line indication of device position in the "driving" phase.

Hydrofoil device 10 may include a front foil 20, a rear foil 30, a steering structure 40, a support frame structure 50 and a user platform 60, among other components. The front foil 20 may be arranged in a "canard" configuration with a water surface finding foil or spoon 21. In the canard configuration, foil 20 and spoon 21 are coupled in a fixed relationship and are in turn coupled at pivot 24 to that lower end of a steering shaft 41. Canard structures for locking on to the water surface are known in the art and any suitable arrangement may be incorporated without deviating from the present invention.

The opposite or top end of steering shaft 41 may include a handle bar 43 or other suitable steering/control handle. Frame structure 50 couples the steering shaft 41 to the user platform 60. Frame structure 50 may include a support shaft 51 that may be comprised of one or more members.

The main frame pivot 55 is provided between steering shaft 41 and support shaft 51. Steering structure 40 may include a coupling member 45 that is pivotally coupled to one end of support shaft 51 at main pivot 55. Steering shaft coupling member 45 may include a cylindrical support shaft 47 with an internal bushing or the like for securely holding steering shaft 41 in a manner that permits user rotation of the steering shaft to achieve turning.

At rest or in coast position (the non-phantom line position in FIG. 3), the top portion of the steering shaft and support shaft are disposed at an angle, a (the support shaft, in this embodiment, configured along a line from the top of the user platform to the main pivot, and the angle $\alpha$ being effectively formed between this line and the top portion of the steering shaft).

The user platform may include left and right foot placement platforms 61,62, a joint structure for coupling to support shaft 51 and a frame member 64 for coupling to the rear or, in the case of the embodiment of FIGS. 1-3, the drive foil. A pair of vertical members 67,68 or another suitable structure may mount the rear foil below the user platform.

Device 10 operates generally as follows. To operate, a user stands on user platform 60 and places his or her hands on handle bar 43. A user may push off of a dock or boat or the like or, if the hydrofoil device has additional flotation components so that it attains a desired position at rest, begin from a still position in the water.

To generate forward movement, a user moves the handle bar to place the drive foil in a desired drive position and then thrusts downward with his or her legs. The downward handle bar movement causes the angle $\alpha$ to decrease and front edge 31 of foil 30 to angle downward as shown in phantom lines in FIG. 3. Downward force onto rear foil 30 in this position causes the rear foil to cut into the water and drive device 10 forward.

As the effect of the downward driving thrust trails off, a user moves the handle bar upward causing the angle $\alpha$ to increase and the front edge 31 of foil 30 to be pulled upward towards the position shown in non-phantom lines in FIG. 3, the "coast" position. By repeating this procedure a user achieves sustained forward movement, resting in the coast position between downward drive thrust. The downward drive thrust of the user is efficiently transferred to driving the device forward since the drive foils is placed at the proper angle prior to (or contemporaneously with) delivery of the downward driving thrust.

In prior art self-propelled hydrofoil devices such as Puzey (the '369 patent), a very strong spring biases the drive foil in the coast position. This spring is too strong for a user to change the position of the drive foil merely through the use of their forearm strength on the handle bar. The spring force of Puzey is overcome by a user jumping on the user platform, using their full weight plus the momentum of the jump to compress the spring.

In contrast, the present invention may be operated without a spring and a user can nearly effortlessly move the handle bar to change the angle of attack of the drive foil with forearm strength alone, and minimal exertion of forearm strength. This is achieved in part because the connection point of the steering shaft is located relatively low to give a user sufficient leverage at the handle bar to readily change the angle of attack of foil 30 (by changing the position of the handle bar). The embodiment of device 10 and others herein give a user much greater control over the drive and coast phases of operation and the overall experience of riding the hydrofoil device.

Further to the embodiment of FIG. 3, it can be seen that at least approximately 30 percent of the steering shaft is located above, i.e., rearward of, the attachment point of the support frame structure 50 to the steering shaft 41 and the amount of steering shaft rearward of the attachment point may be 40 percent, 50 percent or another amount. With 30%, 40%, 50% or more of the steering shaft extending rearward of the point of attachment, approximately 70%, 60%, 50%, or less, respectively, may extend forward. In FIGS. 1 and 3, the portion of the steering shaft rearward of the point of attachment is approximately 50 percent as is the portion extending forward of the attachment point. Design criteria include providing a user with sufficient leverage to set the rear foil at a desired angle of attack.

An added advantage of the present invention is that since a user has control over the angle of attack, by changing the handle bar position, the user can move the drive foil to a given angle of attack as desired. This is particularly helpful when the height of the water surface is changing rapidly, for example, in the presence of a wave or a large boat wake. This level of control permits a user to use the device for surfing. In maneuvering the device out past the wave break line, a user advantageously changes the angle of attack of the foil, e.g., raising the device in the water to effectively ride over an incoming wave.

Figure 5:
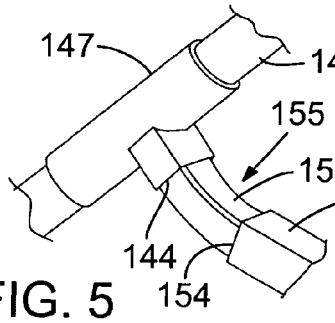
FIGS. 4-12 illustrate other embodiments of a self-propelled hydrofoil device and components thereof configured to increase user leverage and control in accordance with the present invention.
Figure 4:
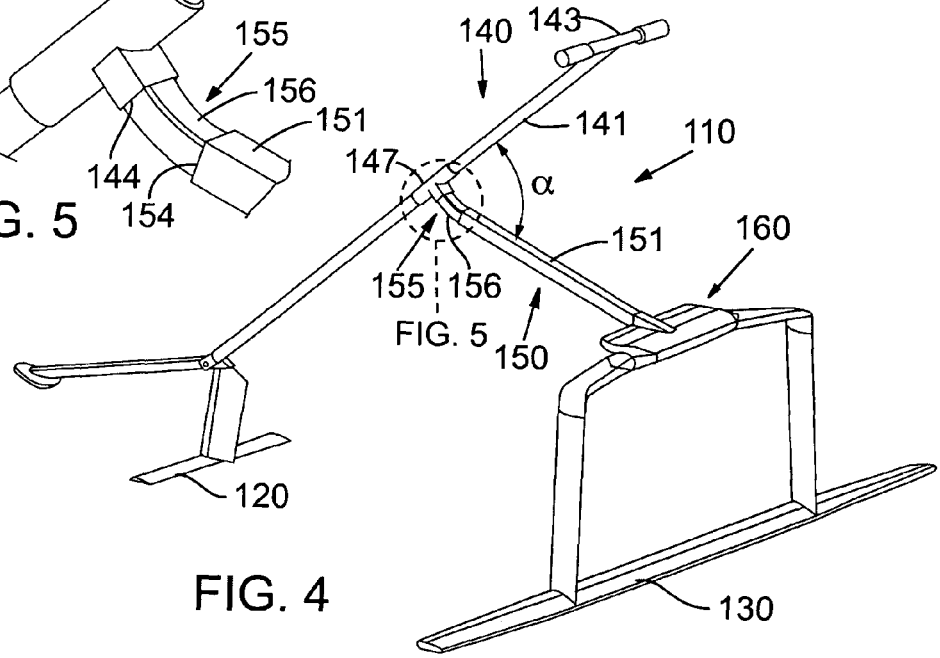

Referring to FIGS. 4-5, another embodiment of a self-propelled hydrofoil device 110 configured to increase user leverage and control in accordance with the present invention is shown. Hydrofoil device 110 may be similar or identical to hydrofoil devices 10 in many aspects, including a front foil 120, rear foil 130, steering structure 140, frame support structure 150 and a user platform 160.

In device 110 of FIGS. 4-5, a flexible joining member 156 couples that support shaft 151 to the steering shaft 141. The flexible joining member may be made of rubber (natural or synthetic, polyurethane, etc.) and effectively functions as the main pivot 155, akin to main pivots 55. Receptacles 154,144 in the support shaft and steering shaft respectively receive and mount to the ends of flexible joining member 156. The joining member may be fastened in place with glue and/or screws or other suitable fastening devices.

The support shaft and steering shaft are preferably arranged at an angle $\alpha$ that affords suitable leverage to a user as discussed herein.

The steering structure may include a support cylinder 147 that supports the steering shaft for rotatable movement therein. Support cylinder 147 may include a bushing or other suitable mechanism for permitting ready turning of the steering shaft in the cylinder.

Figure 7:
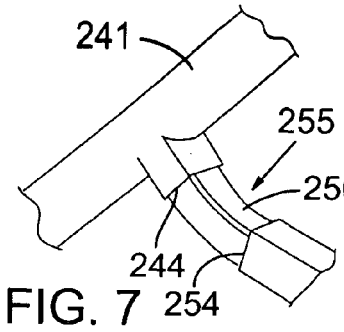
Figure 6:
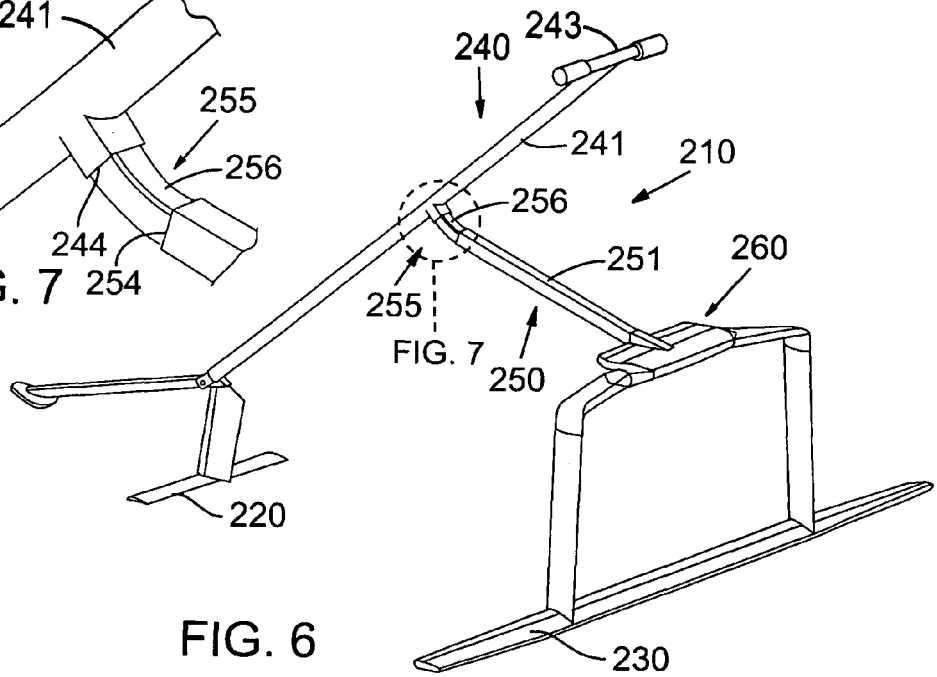

Referring to FIGS. 6-7, another embodiment of a self-propelled hydrofoil device 210 configured to increase user leverage and control in accordance with the present invention is shown. Hydrofoil device 210 may be similar or identical to hydrofoil devices 10,110 in many aspects, including a front foil 220, rear foil 230, steering structure 240, frame support structure 250 and a user platform 260.

In device 210 of FIGS. 6-7, a flexible joining member 256 couples that support shaft 251 to the steering shaft 241. The flexible joining member may be made as described above for flexible joining member 156 of FIGS. 4-5. Similarly it effectively functions as the main pivot 255, akin to main pivots 55,155. Receptacles 254,244 in the support shaft and steering shaft respectively receive and mount to the ends of flexible joining member 256. The joining member may be fastened in place with glue and/or screws or other suitable fastening devices.

The support shaft and steering shaft are preferably arranged at an angle α that affords suitable leverage to a user as discussed herein.

In contrast to device 110 of FIGS. 4-5, device 210 is configured such that receptacle 243 is coupled non-movably to steering shaft 241. Turning is achieved not by a rotatable bushing or the like, but rather through movement of the flexible joining member. The flexible joining member, movable to pivot the steering shaft up and down is also moveable to turn the steering shaft left and right, effectively steering device 210. The provision of a flexible joining member in this capacity simplifies device design by reducing the number of moving parts, and further achieves all the benefits of the present design (leverage, no spring operation, etc.) in a streamline design that accommodates movement for foil position and movement for turning via the same mechanism.

Figure 8:
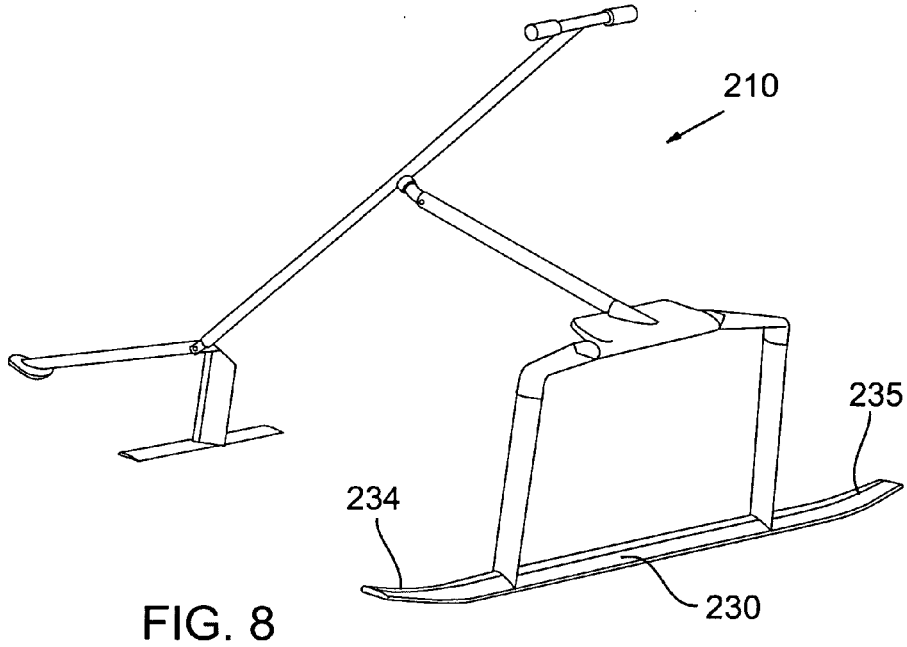
Figure 9:
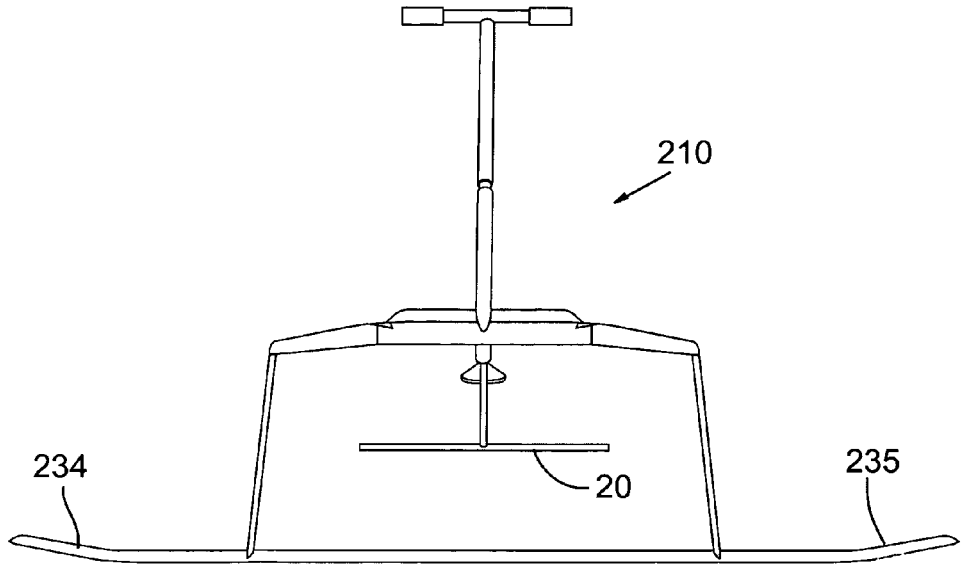

Referring to FIGS. 8-9, a rear-side perspective view and a rear elevation view of hydrofoil device 210 of FIGS. 6-7 with a dihedral rear foil 230 in accordance with the present invention are respectively shown. In the embodiment of FIGS. 8-9, the drive foil 30 includes an upward tilted member or "wing tip" 234,245 on each end. These tilted tips "balance" the foil in the water causing it to self-center. This in turn reduces physical stress in the region of pivot 255.

Figure 11:
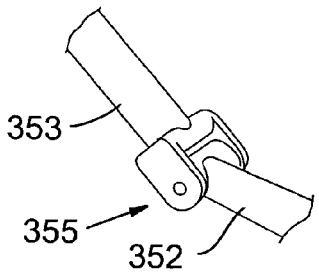
Figure 10:
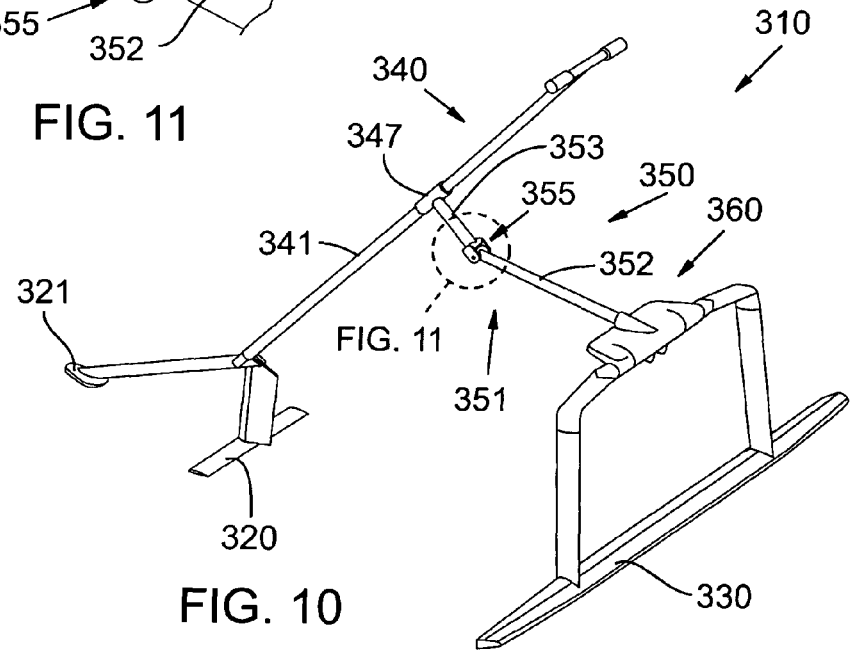
Figure 12:
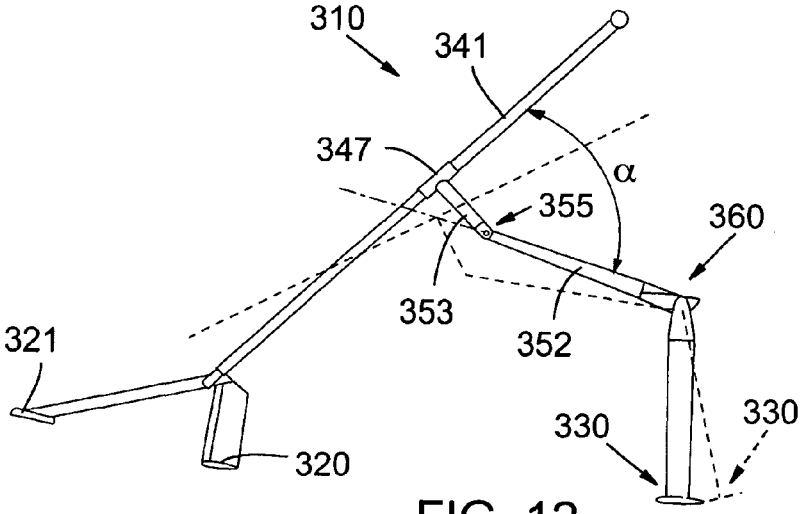

Referring to FIGS. 10-12, another embodiment of a self-propelled hydrofoil device 310 configured to increase user leverage and control in accordance with the present invention is shown. FIG. 10 illustrates a perspective view from the side-rear, FIG. 11 illustrates a sectional view of the main frame pivot and FIG. 12 is side elevation view that includes a phantom line indication of device position in the "driving" phase.

Hydrofoil device 310 may be similar or identical to hydrofoil devices 10 in many aspects, including a front foil 320, rear foil 330, steering structure 340, frame support structure 350 and a user platform 360.

In the embodiment of FIGS. 10-12, the support shaft 351 has two parts: a primary frame member 352 and a coupling frame member 353.

The main frame pivot 355 is provided between the primary and coupling frame members. The coupling frame member serves principally as an extension of steering shaft 341, and thus, the main pivot 355 is essentially a pivot between steering shaft 341 and support shaft 351. It should be recognized that coupling frame member 353 may be very short, approaching zero as shown in previous figures, or may be longer or otherwise configured.

The primary frame member 352, if extended out as indicated by the dash-dot line (from the top of the user platform to the pivot), would intersect the steering shaft at a point approximately halfway down the steering shaft. This is the effective pivot point of the steering shaft, and is designed to be at a position that affords appropriate leverage and defines the angles α discussed above.

It should be recognized that the steering shaft has at least approximately 40% of its length extending above the point of attachment of frame member 353 to the steering shaft (at cylindrical shaft 347). This percentage may be 33% (one-third of its length), 30% or less, depending on the length of frame member 353.

Figure 13:
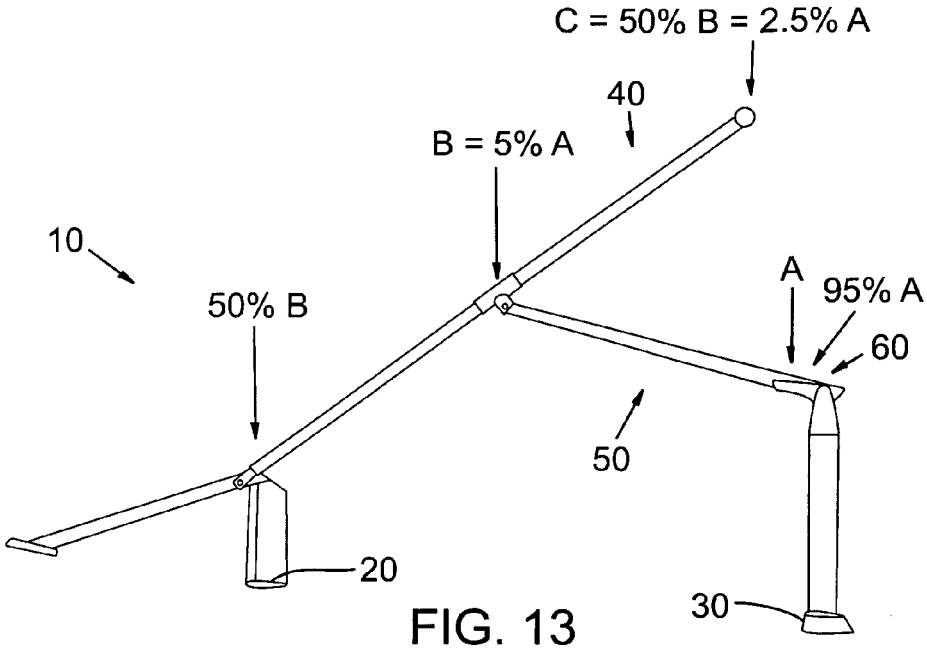
FIG. 13 illustrates one potential arrangement of weight distribution in a self-propelled hydrofoil device in accordance with the present invention.

Referring to FIG. 13, a diagram of one potential arrangement of weight distribution in a self-propelled hydrofoil device in accordance with the present invention is shown. Using hydrofoil device 10 of FIG. 1 in this representative example, FIG. 13 illustrates that for a user at user platform 60, 95% of the user's weight falls on the user platform and 5% on the steering shaft 41. Since the attachment point is at about halfway along the steering shaft, approximately half of this 5% is delivered to the canard and the other half to the handle bar 43. Thus, the weight or force that a user needs to move the handle bar is approximately 2.5% of the user's weight. For a 100 pound user this is 2.5 pounds, for a 200 pound user this is 5 pounds. Both are very small amounts. While the dimension of the components of device 10 may be modified to change the amount of force, i.e., percentage of a user's weight, that must be applied to the handle bar to move it, this amount may be 25% or less, more preferably 15% or less, and still more preferably 5% or less (the 2.5% discussed above, for example, being less than 5%).

Figure 14:
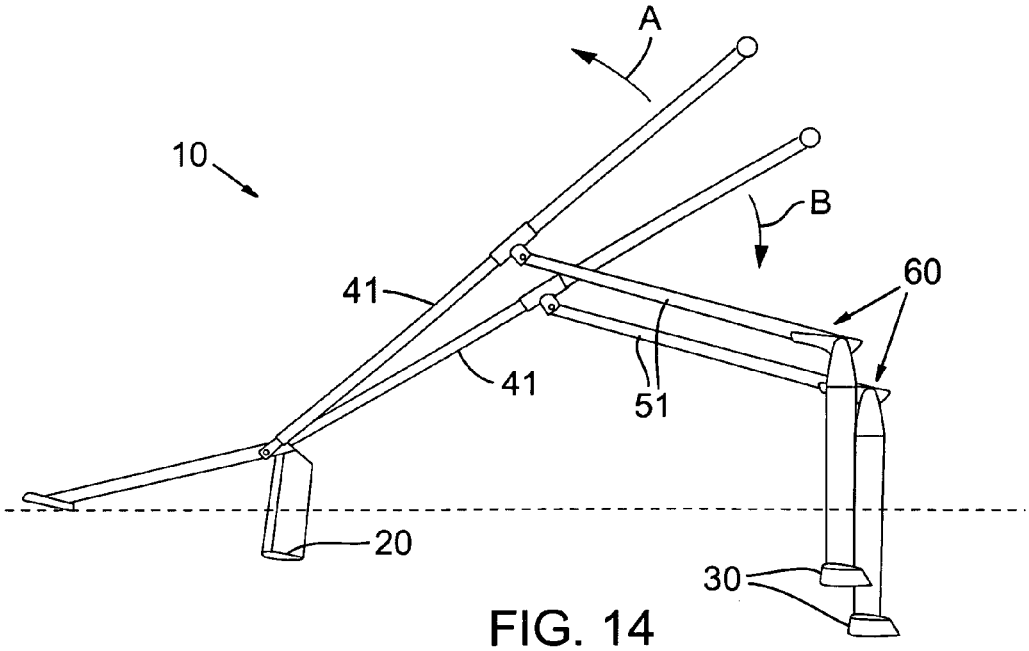
FIG. 14 illustrates one embodiment of the present invention coasting at different heights in the water.

Referring to FIG. 14, one embodiment of a self-propelled hydrofoil device in accordance with the present invention, for example, device 10 of FIG. 1, is shown coasting at two different heights.

FIG. 14 is intended to emphasize the ability of a user to adjust the height of device 10 (or other embodiment discussed herein) in the water. For example, as noted above in the context of being able to ride over incoming waves to use device 10 for surfing, etc., it is possible to adjust the height at which the device is coasting or "flying" through the water.

The support shaft 51 may be movably coupled to the steering shaft and the steering shaft movably coupled to the canard. With the canard locking onto the surface of the water, raising handle bar up 43 (direction Arrow A) will move the rear foil higher in the water column and raise user platform 60 and device 10 in general. Conversely, lowering handle bar up 43 (direction Arrow B) will move the rear foil lower in the water column and lower user platform 60 and device 10 in general. This feature provides the user with more control, enhancing the riding experience and providing a user with tools for more sustained and enjoyable operation, e.g., riding over waves and wakes, avoiding objects in the water or turbulent water, etc.

Note that the hydrofoil devices herein may be constructed with a collapsible drive foil and with other collapsible members for compact storage and transport, as taught at least in part by the parent application.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A self propelled hydrofoil device, comprising:

a front foil;

a steering structure including a steering shaft that is substantially continuous and has a handle at one end and the front foil coupled to the other end;

a second foil;

a user platform that is wider than long and provided above the second foil;

a plurality of vertically disposed members that descend from the user platform to the second foil to transfer a downward directed drive force from the platform to the second foil; and a support frame that couples to the steering shaft;

wherein the steering shaft is pivotally coupled to the support frame wholly between the front foil and the second foil and extends continuously forward of the support frame coupling point to the front foil coupling end such that pivotal movement of the handle up and down imparts a see-saw movement on the steering shaft and the front foil, with downward movement of the handle causing the front foil to move upward and upward movement of the handle causing the front foil to move downward.

2. The device of claim 1, wherein the front foil is pivotally coupled to the foil end of the steering shaft.

3. The device of claim 1, wherein, in use, the device operates with the front and second foil in a drive position and a coast position and a user places the device in one or the other of the drive and coast positions by moving the handle up or down to the corresponding position, and wherein the front foil can be placed via the see-saw movement through a range of motion including being above and below the coast position.

4. The device of claim 3, wherein the steering shaft extends at least approximately 50% of its length forward of the point of pivotal coupling to the support frame.

5. The device of claim 1, wherein the steering shaft is substantially continuous and linearly disposed and is pivotally coupled to the support frame at a point that is approximately 40% or more of the distance from the front foil to the second foil.

6. The device of claim 5, wherein the steering shaft extends at least approximately 40% of its length above the point of attachment.

7. The device of claim 1, wherein the support frame is coupled to the steering shaft through a flexible rubber joining member that is made of material having elastic properties, and the joining member achieves structural coupling and pivotal movement in two mutually orthogonal planes due to the elastic properties of the rubber material from which the joining member is made.

8. The device of claim 7, wherein the flexible joining member is sufficiently flexible to achieve turnable mounting of the steering shaft.

9. The device of claim 1, wherein the second foil has a dihedral shape.

10. The device of claim 1, wherein the support frame includes a support shaft and the support shaft is pivotally coupled to the steering shaft at a point proximate the steering shaft.

11. The device of claim 1, wherein the support frame includes a support shaft that is at least bi-partite including a first part coupled to the user platform and a second part coupled to the steering shaft, the steering shaft being pivotally coupled to the user platform through a pivotal coupling of the first part to the second part.

12. The device of claim 1, wherein the steering shaft is pivotally coupled to the support frame at a point such that approximately 30% to 50% of the length of the steering shaft extends rearward of the point of pivotal coupling.

13. A self propelled hydrofoil device, comprising:

a front foil;

a steering structure including a steering shaft having a handle bar end and a front foil end, with a handle bar coupled to the handle bar end and the front foil coupled to the front foil end;

a second foil;

a user platform that is coupled to the second foil by an accompanying vertical support structure, the user platform and accompanying vertical support structure being wider than long; and a support frame coupled to the user platform;

wherein the steering shaft is movably coupled to the support frame for movement relative to the support frame in a substantially vertical plane in the line of direction of movement of the device and the front foil is located wholly forward of the point of movable coupling of the steering shaft to the support frame; and wherein the device is configured to operate in a coast position and a drive position and be transitioned between these two positions by movement of the handle bar up and down by a user, movement of the handle bar up imparting a downward movement onto the front foil relative to the second foil and movement of the handle bar down imparting an upward movement onto the front foil, and wherein the front foil can be moved via movement of the handle bar through a range of motion including being above and below the coast position.

14. The device of claim 13, wherein the support frame ascends diagonally to the steering shaft.

15. The device of claim 13, wherein the steering shaft is substantially continuous and linearly disposed and is movably coupled to the support frame at a point that is effectively and substantially equidistant between the handle bar end and the front foil end.

16. The device of claim 13, wherein the support frame is coupled to the steering shaft through a rubber flexible joining member that is made of a material having elastic properties, and the joining member achieves structural coupling and pivotal movement in two mutually orthogonal planes due to the elastic properties of the rubber material from which the joining member is made.

17. The device of claim 13, wherein the steering shaft is pivotally coupled to the support frame at a point such that approximately 30% to 50% of the length of the steering shaft extends behind the point of pivotal coupling.

18. The device of claim 13, wherein the second foil has a dihedral shape.

19. The device of claim 13, wherein the support frame includes a support shaft and the support shaft is pivotally coupled to the steering shaft proximate the steering shaft.

20. A self propelled hydrofoil device, comprising:

a front foil;

a steering structure includes a substantially continuous and longitudinally disposed steering shaft that has a front foil end coupled to the front foil and a handle end coupled to a handle;

a second foil;

a user platform that is wider than long and provided above the second foil, wherein wider is measured in a dimension substantially perpendicular to the line of straight forward travel of the device and long is measured in a dimension substantially parallel to the line of straight forward travel of the device;

a plurality of vertically disposed members that descend from the user platform to the second foil to transfer a drive force from the user platform to the second foil; and a support frame that couples the steering structure to the user platform;

wherein the steering shaft is pivotally coupled to the support frame for up and down movement at a point along the steering shaft that is between approximately 30% and 70% of the length of the steering shaft.

21. The device of claim 20, wherein the support frame includes a support frame member that ascends diagonally from horizontal and the steering shaft is pivotally coupled to the support frame for up and down movement at a point such that approximately 30% to 50% of the length of the steering shaft extends rearward of the point of pivotal coupling.

22. The device of claim 20, wherein the steering shaft is pivotally coupled to the support frame for up and down movement at a point that is effectively and substantially equidistant between the handle end and the front foil end.

23. The device of claim 20, wherein the support frame is coupled to the steering shaft through a flexible joining member that is made of a material having elastic properties, and the joining member achieves structural coupling and pivotal movement in two mutually orthogonal planes due to the elastic properties of the material from which the joining member is made.

24. The device of claim 20, wherein the second foil has a dihedral shape.

25. The device of claim 22, wherein the steering shaft is linearly disposed.

* * * * *